United States Patent [19]

Monahan

[11] Patent Number: 5,065,579

[45] Date of Patent: Nov. 19, 1991

[54] FEEDBACK AIR-FUEL CONTROL SYSTEM FOR STIRLING ENGINES

[75] Inventor: Russell Monahan, Ann Arbor, Mich.

[73] Assignee: Gas Research Institute, Chicago, Ill.

[21] Appl. No.: 596,516

[22] Filed: Oct. 12, 1990

[51] Int. Cl.[5] ..... F02G 1/045

[52] U.S. Cl. ..... 60/524

[58] Field of Search ..... 60/524

[56] References Cited

U.S. PATENT DOCUMENTS

| | | | |
|---|---|---|---|
| 3,956,892 | 5/1976 | Nystrom | 60/524 |
| 4,327,551 | 5/1982 | Grossmann et al. | 60/524 |
| 4,384,457 | 5/1983 | Harvey | 60/524 |

*Primary Examiner*—Allen M. Ostrager

*Attorney, Agent, or Firm*—Brooks & Kushman

[57] ABSTRACT

A control system for Stirling engines includes a feedback control from a sensor for detecting oxygen levels in the exhaust from the combustion system of the Stirling engine. The sensor generates a feedback signal which is converted for inputting into a microprocessor control system. The input signal is compared with a reference signal to readjust the air-fuel mixture set by control apparatus responsive to at least one engine operating condition such as working fluid temperature. The microprocessor control system generates control signals for both an electronic pressure regulator and a combustion blower so that both as pressure and air flow are adjusted according to engine operating requirements. Either a universal or a lean exhaust gas oxygen sensor is preferably employed in the feedback control.

15 Claims, 2 Drawing Sheets

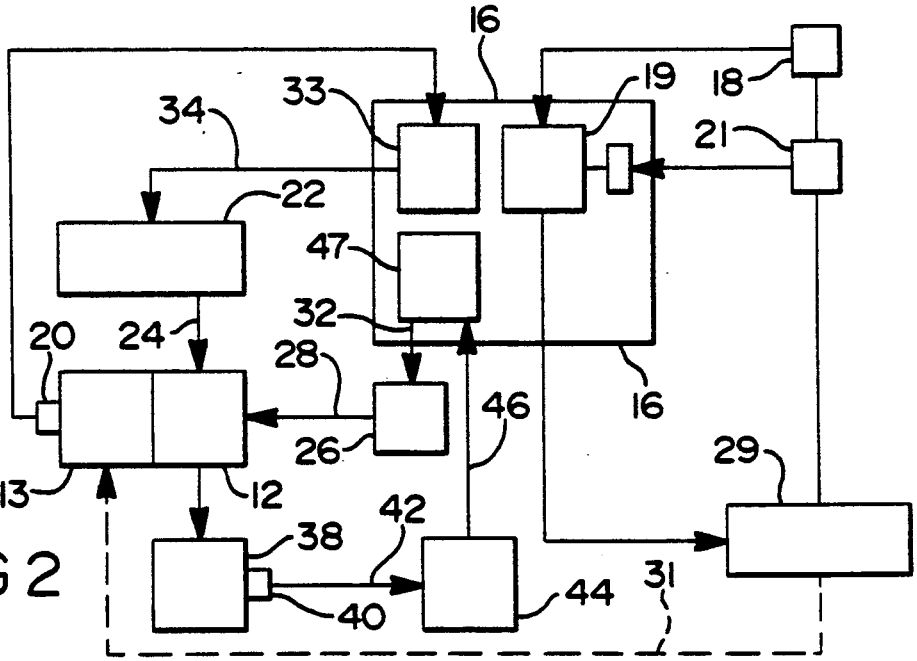
FIG 2
FIG 3
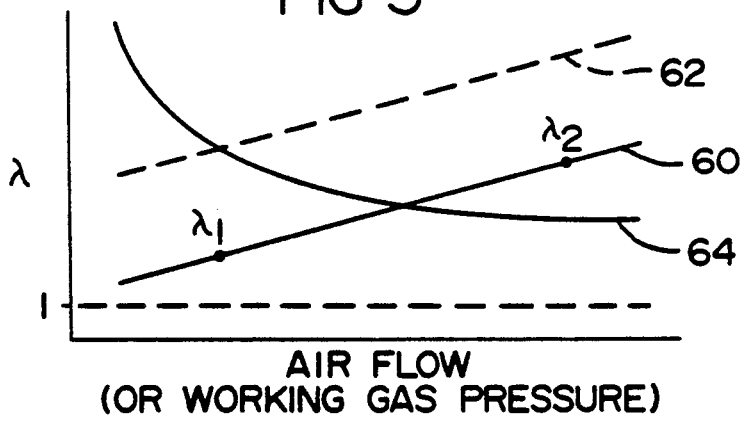
FIG 4
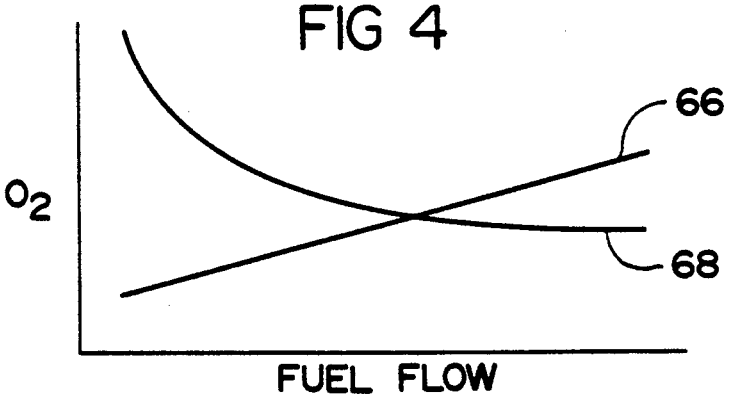

FEEDBACK AIR-FUEL CONTROL SYSTEM FOR STIRLING ENGINES

TECHNICAL FIELD

The present invention relates generally to air-fuel control systems for Stirling engines, and more particularly to a feedback control system for adjusting the air-fuel ratio to natural gas-fired Stirling engines.

BACKGROUND ART

A Stirling engine is a known external combustion engine in which heat supplied from the combustion process is transferred by a primary heat exchanger or the like to a pressurized working fluid in a drive system of the engine. Mechanical work is produced by fluid expansion during an isothermal expansion cycle phase when heat is transferred to the working fluid. To maintain maximum work output from the engine, the temperature of the working fluid should be maintained at a constant level at an upper limit determined by the metallurgical composition of the engine's primary heat exchanger.

Unlike internal combustion engines, in which the expansion of gases due to combustion moves the piston, the heat output of the combustion of the air-fuel mixture is varied to maintain the high temperature of the working fluid in the drive system of the Stirling engine. Thus, temperature sensing of this working fluid comprises the primary indicia for control of the air-fuel ratio in previous Stirling engine controls. Typically, an air compressor is controlled in response to the change in temperature and the air passes through a throttle body with a fuel inlet. Such control of the air-fuel ratio delivered to the combustion chamber does not maintain the proper air-fuel which optimizes the efficiency of combustion and reduces the release of harmful exhaust products. Furthermore, it produces hot spots in the combustion chamber due to incomplete mixing of the air and the fuel.

While the air-fuel mixture may be varied to adjust the output of both internal and external combustion engines, the conditions under which the air-fuel ratio must be adjusted are substantially different. In particular, it will be appreciated that the air-fuel ratio in previously known Stirling engines may be substantially higher than the air-fuel ratios commonly encountered in internal combustion engines, and the higher level of air controls heat transfer to the working fluid. Moreover, the combustion chamber does not support reciprocating pistons and may be constructed of less durable materials such as sheet metal. However, such material is more vulnerable to uneven heating problems. The problem of uneven heating has been evident when control of the air-fuel ratio has been provided by adjusting air-flow through a throttle body. As a result, previously known apparatus and methods for adjusting the air-fuel ratio in internal combustion engines are not readily applicable to the air-fuel mixture controls in Stirling engine systems.

U.S. Pat. No. 4,231,222 discloses an air-fuel control system for Stirling engines adapted to overcome the problem of controlling previously known fuel injection devices throughout a wide range of air-fuel ratios required. A temperature sensor generates a signal in response to deviation of working fluid temperature from its desired limit to control an air flow throttle valve. Variations in air flow of the combustion circuit is then sensed by a vortex shedding device which delivers a DC electrical signal to control one or more solenoid type fuel injectors feeding a common manifold leading to the fuel nozzle for the combustion circuit. Exhaust gas recirculation is controlled by a valve which also affects the air-fuel ratio input to the combustion chamber.

U.S. Pat. No. 3,956,892 to Nystrom discloses a Stirling engine which utilizes a closed loop fuel control system regulated by a temperature sensor. The system delivers a constant amount of fuel and air per unit time in an amount which is less than necessary for idling when the sensed temperature is above a predetermined level, and delivers a constant amount of fuel and air which is more than necessary to generate the heat required for maximum engine output. The duration of the delivery of those higher and lower amounts of fuel and air is varied depending upon engine load. As a result, the sensed temperature does not affect the air-to-fuel ratio and provides a simple apparatus for control of the combustion in the Stirling engine.

U.S. Pat. Nos. 4,083,342; 4,007,718; 4,023,357; 4,146,000; 4,052,968; 3,977,375; and 3,931,710 disclose carburetor controls for internal combustion engines in which exhaust gas constituents are sensed to provide a signal that controls the introduction of bypass or secondary air downstream of the air-fuel mixing throat of the carburetor.

U.S. Pat. No. 4,096,839 discloses an air-fuel ratio control system for internal combustion engines in which an oxygen sensor is used to maintain the primary intake air-fuel ratio at a predetermined level whereas the second intake is controlled in response to exhaust pressure to control the amount of fuel fed to the internal combustion chamber.

U.S. Pat. No. 4,191,149 discloses an air-fuel control for internal combustion engines which provides an increased range of pressure to the carburetor float chamber which may be beyond the levels of the compressor source pressure and atmospheric pressure.

U.S. Pat. No. 4,291,659 discloses a three-stage control in which only the third stage of operation adjusts the air pressure in the fuel passages opened to the venturi nozzle and the bypass port in the carburetor for an internal engine combustion.

U.S. Pat. No. 3,911,884 discloses a fuel injection system for internal combustion engines with a fuel metering control and having a fuel pressure regulator responsive to the magnitude of the sensor signal detecting the presence of oxygen in the exhaust gases providing fuel to the metering control.

U.S. Pat. No. 3,952,710 discloses an air-fuel ratio control system for internal combustion engines in which the oxygen sensor alternately controls the injection of air or the injection of fuel depending upon whether the concentration of oxygen in the exhaust gases is higher or lower than a predetermined concentration or air-fuel ratio.

U.S. Pat. No. 4,043,305 discloses an internal combustion engine in which an exhaust gas sensor controls an electrical valve within an exhaust gas recirculating duct. The control of the air into the intake passage is responsive to the pressure within the exhaust outlet.

The patents relating to internal combustion engine control devices do not describe how such controls can be effectively applied to external combustion engines. In particular, they do not teach or suggest the adjustment of both air flow and fuel pressure in response to a combination of primary heat exchanger temperature and exhaust gas composition.

TECHNICAL PROBLEM RESOLVED

The present invention overcomes the inefficiency of previously known Stirling engines having conventional controls for the air-fuel ratio. A universal or lean exhaust gas oxygen sensor provides an electrical output to a signal-conditioning module. The signal-conditioning module provides a signal to a microprocessor control system in which the signal is processed in combination with signals representing other engine operating conditions. The microprocessor pilots both air flow control and gas feed pressure control to the air and fuel inlets to the Stirling engine combustion system.

Preferably, the signal from the sensor signal-conditioning module is compared with a predetermined oxygen level signal, such as known performance parameters as designated in the drawing, to provide a representative signal of changing conditions through appropriate proportioning, integrating and/or differentiating software and microprocessor circuitry that delivers a control signal to a fuel pressure regulator. At the same time, one or more other sensors, preferably a sensor monitoring heat exchanger temperature either at its input or the working fluid output in the engine system, provides an input to the microprocessor which in turn modulates the signal to the air compressor. Moreover, sensors for other exhaust gas emissions, for exhaust gas pressure, for working fluid pressure, for load upon the drive system or for the speed of the output of the drive system may additionally be employed to provide a control signal to the microprocessor. As a result, the control system of the present invention provides a more efficient use of fuel by monitoring air-fuel conditions within the combustion system while adjusting to changes in the temperature of the working fluid and other operating conditions which effect the operation of the drive system for a Stirling engine.

In the preferred embodiment shown, the fuel pressure is first adjusted by the change of venturi pressure due to changes in compressor operation. The compressor changes are determined by sensing a temperature change. However, when only venturi pressure controls the air-fuel ratio, the air-fuel ratio can vary in a manner unrelated to desired performance as the compressor output increases. Conversely, the mixture can become rich when the load is reduced and when the corresponding drop in working fluid pressure signals for reduced compressor output, as occurs at idle speed. To balance the air-fuel ratio throughout the load range, the feedback loop of the preferred embodiment further adjusts the fuel pressure to regulate the combustion process and compensates for these variations. As a result, hot spots in the combustion chamber are avoided and thorough mixing of the air-fuel mixture improves efficiency.

BRIEF DESCRIPTION OF THE DRAWING

The present invention will be more clearly understood by reference to the following detailed description of a preferred embodiment when read in conjunction with the accompanying drawing in which like reference characters refer to like parts throughout the views and in which

FIG. 2 is a flow diagram defining a microprocessor controlled operation of the control system according to the present invention;

FIG. 3 is a graphic representation of the general relationship between air fuel ratio and both working gas pressure and air flow; and FIG. 4 is a graphical representation of the general relationship between the oxygen level sensed and fuel flow.

BEST MODE FOR CARRYING OUT THE INVENTION

Figure 1:
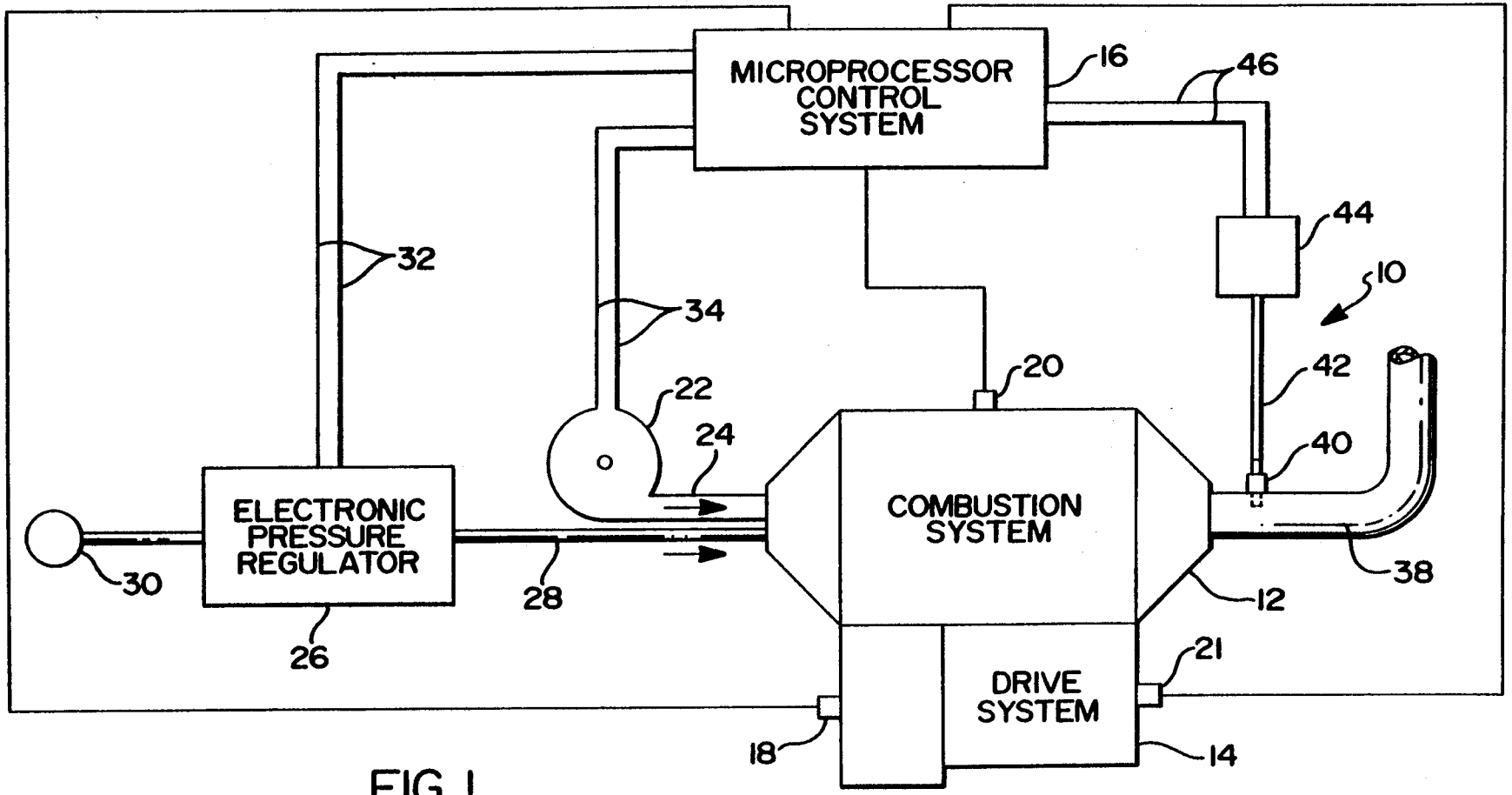
FIG. 1 is a general schematic view of a Stirling engine with a control system according to the present invention.

Referring to FIG. 1, a hot gas engine system 10, such as a V-160 Stirling engine, is shown comprising a combustion system 12 and a drive system 14. The combustion system 12 of the present invention differs from previously known Stirling engine combustion systems in that it has been modified to adjust the air-fuel ratio in a manner to be described hereinafter. The drive system 14 of the Stirling engine is also of conventional type and need not be described in further detail.

The combustion system 12 includes a microprocessor control unit 16 as is typically provided with the V-160 Stirling engine. Such a control unit can be made responsive to a number of inputs such as speed sensors 18 for sensing shaft speed or engine load, as well as temperature sensor 20 communicating with the primary heat exchanger 13 (FIG. 2) for the working fluid in a well known manner. Furthermore, a working gas pressure sensor 21 also provides input to the microprocessor control unit 16. Sensors for such conditions are well known and need not be described in greater detail for purposes of describing the present invention.

As in previously known Stirling engine systems, both air and fuel are fed into the combustion chamber. A combustion blower 22 may be engine driven, or preferably, driven by a separate, variable speed electric motor or the like, to introduce air into the combustion system through a conduit 24. The conduit 24 includes a venturi passageway including an orifice in communication with a supply of fuel, such as natural gas, through a conduit 28. The venturi passageway mixes fuel with the air introduced to the combustion chamber in a well known manner. A signal transmitted through electrical conductor 34 controls the speed of compressor 24 and varies the amount of air delivered through the blower outlet 24 into the combustion system.

In the preferred embodiment of the present invention, an electronic pressure regulator 26 is introduced between a pressurized natural gas supply 30 and the conduit 28 to control the pressure of fuel fed through outlet 28 from a pressurized natural gas supply 30. The pressure regulator 26 may be of the solenoid type which responds to an electrical regulator control signal transmitted through conductors 32 from the microprocessor control system 16.

The microprocessor control system 16 may be of a known type such as the previously known V-160 microprocessor control unit for the V-160 Stirling engine system. Accordingly, the microprocessor control system is adapted to receive and analyze the inputs from other condition sensors. As shown in the preferred embodiment, condition sensors such as an engine speed i.e. load, sensor 18, a working fluid pressure sensor 21 and a temperature sensor 20 provide data signals to be used in controlling the air-fuel ratio delivered to the combustion chamber. However, in addition, the reference level or the feedback level may also be set by sensing other operating conditions as desired, such as the level of other gas constituents or emissions in the exhaust.

In the preferred embodiment, an exhaust gas sensor 40 is used to provide an analog signal whose signal level corresponds with the level of oxygen sensed in the exhaust outlet 38 of the combustion system. In the preferred embodiment, the universal exhaust gas oxygen sensor comprises an NGK UEGO and corresponding signal conditioning module. However, the sensor 40 may be of any known type which provides an electrical output representative of the oxygen level to which the sensor is exposed. This signal is transmitted by a line 42 to a NGK universal exhaust gas oxygen signal conditioning module 44 which amplifies the analog signal to obtain an analog signal which the microprocessor control system can use. This analog signal is delivered through conductor input 46 coupled to the microprocessor control system 16. Internal to the microprocessor control system, an analog-to-digital converter of known type may be used to provide a digital control signal to the microprocessor itself. Accordingly, an NGK LEGO sensor, operable at or above stoichiometric ratios, is also a useful substitute. Of course, other known sensors, such as transducers which generate a signal whose frequency is proportional to oxygen level with a conditioning unit for converting the signal to a voltage level signal, could also be employed.

As shown in greater detail in FIG. 2, the combustion cycle and a drive cycle are represented in flow chart form. On the left side, the control signal delivered by the conductor 34 runs the compressor 22 to generate air flow output. The air flow is directed through a venturi nozzle in a well known manner to mix fuel with the air flow in the combustion chamber. In FIG. 2, the combustion system 12 shows both heat energy output as is well known in the prior art, as well as an exhaust gas output which is used to advantage in practicing the present invention.

The heat energy output monitor may be a temperature sensor for the combustion product in the Stirling engine combustion system. However, in the preferred embodiment, the temperature of the working fluid of the Stirling engine primary heat exchanger 13 provides an input to the microprocessor 16. The signal from the temperature sensor 20 is coupled through selected P-I-D circuitry as in known microprocessor controls for V-160 Stirling engines to provide an electrical signal output at the conductor 34 to change the air flow output generated by the compressor 22. The term P-I-D circuitry as used in the description refers generally to known types of circuits and software, alternatively as well as in combination, which proportion, integrate, or differentiate inputs to determine a change from previous conditions which must be addressed. In the preferred embodiment, proportional and integration circuitry has been found to be most useful throughout the operating ranges and conditions encountered by the Stirling engine, although it is to be understood that the invention is not so limited. In any event, the construction of such circuitry and software to produce the control signal is well known and need not be discussed in greater detail for the process of the invention.

An additional circuit feature employing the microprocessor control unit 16 comprises a speed sensor 18 for determining the load applied to the Stirling engine. Typically, a magnetic pick-up such as Airpax VR-Series variable reluctance sensor or other known type of sensor provides an output that corresponds with the speed of the shaft monitored by the sensor. In a preferred application of the Stirling engine to form a gas-fired heat pump system, the shaft speed may be closely indicative of the load applied by the pump and the need to transfer heat energy from the combustion system to the drive system. The output of the sensor 18 is input to conventional P-I-D circuitry to provide a control signal to the power control system 29.

A power control system of known type such as a mean pressure control is employed in the preferred embodiment. Such a control includes a compressor, a storage tank and solenoid valves which operate in a known manner to transfer working fluid such as helium between the storage tank and the cycle and buffer volumes of the drive system in a known manner. In summary, output torque can be increased by introducing working fluid into the engine from the storage tank and reducing torque by extracting working fluid from the engine by means of the compressor. The pressure of the working fluid in the engine affects the transfer of heat energy to the working fluid as indicated at 31 in FIG. 2. In any event, the pressure within the engine is monitored by a sensor 21 so that when the upper pressure limit has been reached, the P-I-D circuitry 19 is disenabled from working the power control system 29 to increase the pressure of the working fluid.

While both of the above discussed circuits affect the air fuel mixture delivered to the combustion system, the present invention also provides an additional feedback control. The sensor 40 determines the oxygen content of the combustion exhaust gas and delivers an output to a signal conditioning unit 44. The signal conditioning unit 44 introduces an input to the P-I-D circuit 47 which generates a control signal to output 32. The control signal to the electronic pressure regulator 26 regulates the output pressure 28 affecting the mixture of fuel with air within the combustion system 12. A conventional pressure regulator, such as a Maxitrol MR 212 Modulator/Regulator Valve, is used in the preferred embodiment.

Having thus described the structural requirements for the present invention, the method of operating the Stirling engine according to the present invention may be readily understood. While combustion in a Stirling engine occurs at a much higher air-fuel ratio than occurs in internal combustion engines, the greater air flow tends to control heat which is transferred to the working fluid in the Stirling engine drive system 14. Conversely, higher fuel content of a lower air-fuel ratio mixture in the combustion system results in higher temperatures as may be required by the engine load. The need for greater heat was often previously detected by sensing that the temperature of the working fluid is less than a desired optimum temperature. However, pressure changes in the drive system also affect heat transfer and provide an indication of operating conditions which can be used for changing the air-fuel mixture delivered to the combustion system. The present invention enables the control of the emission of certain combustion products in the exhaust of a combustion system to be used to adjust the air-fuel ratio. Such control can be especially advantageous to maintain a desired air-fuel combination throughout a wide range of conditions.

In the present invention, one or more sensors for detecting the conditions can be used to set a controlled reference level for the air-fuel ratio being introduced by actuation of the compressor 22. The feedback control system of the present invention includes a sensor-responsive fuel pressure regulator to readjust the fuel pressure. The microprocessor control system 16 enables this input to affect the air fuel ratio as desired.

A particular problem resolved by the preferred embodiment of the present invention is that an air fuel ratio controlled by the compressor output is richer at lower compressor output and leaner at high compressor output and as demonstrated at $\lambda_1$ and $\lambda_2$ respectively, on curve 60 in FIG. 3 and curve 66 in FIG. 4. With previously known adjustments of the air flow capacity, the air fuel ratios could be adjusted as shown by curve 62.

With the apparatus described for the preferred embodiment, as the load on the engine decreases, the shaft speed increases and is detected by the speed sensor 18. As a result of the P-I-D circuitry 19, the control signal to the pressure control 29 pumps working gas back to the reservoir in a well known manner. As a result, the working gas pressure decreases as detected by the sensor 21. As the pressure of the working gas decreases, the amount of heat which needs to be transferred to the working gas to maintain constant working gas temperature decreases. As a result of less fluid mass to transfer heat, the temperature of fluid in the primary heat exchanger increases. The increase in temperature is sensed by the sensor 20 and is input to the microprocessor control unit 16. As a result of processing through the P-I-D circuitry 33, the control signal output provided to the compressor 22 is decreased. Accordingly, the air flow and thus the venturi pressure in the combustion chamber is also decreased so as to reduce the flow of fuel into the combustion chamber.

Nevertheless, the air fuel mixture tends to be richer at low compressor air flow as previously discussed. Accordingly, the present invention senses the change in the exhaust gas oxygen level by the sensor 40. The microprocessor control 16 through the P-I-D circuitry 47 further adjusts the fuel pressure control signal delivered to the fuel pressure regulator 26 to further control the air-fuel mixture introduced to the combustion chamber. Thus, in the preferred embodiment, the engine control avoids the problem that the air-fuel mixture drifts toward a rich mixture when low working fluid pressure is encountered as at idling speed. The desired changes which can be obtained in the air-fuel mixture are represented in FIGS. 3 and 4 by curves 64 and 68 respectively.

As a result, a regulator signal 32 delivered to the electronic pressure regulator 26 and the blower signal 34 delivered to the combustion blower 22 are adjusted as necessary to maintain heater head temperature as well as efficiency and reduced exhaust emissions. Both air flow into the combustion system 12 and the pressure of fuel such as natural gas supplied to the combustion system 12 can be adjusted to meet the operating requirements of the Stirling engine system. The feedback loop permits engine operation to be guided by an exhaust gas oxygen sensor. Thus, the invention avoids hot spots in the combustion chamber and enhances thorough mixing of the air and fuel introduced.

Having thus described the present invention, many modifications thereto will become apparent to those skilled in the art to which it pertains without departing from the scope or spirit of the present invention as defined in the appended claims.

What is claimed is:

1. In combination with a Stirling engine having an air-fuel ratio control and an exhaust gas emission outlet, the improvement comprising:

an oxygen sensor in communication with said exhaust gas emission outlet for generating an output signal representative of the oxygen content in said outlet;

a sensor signal conditioning unit for adapting said output signal to a conditioned input signal for a microprocessor; and a microprocessor controlled pilot for adjusting said air-fuel control in response to said control input signal.

2. The invention as defined in claim 1 wherein said pilot comprises means for generating a reference level signal responsive to at least one engine output condition, and means for comparing said reference signal to said conditioned input signal.

3. The invention as defined in claim 2 wherein said sensor means comprises at least one sensor selected from the group consisting of working fluid pressure sensor, a temperature sensor, an engine speed sensor, an engine load sensor, and an exhaust gas emissions sensor.

4. The invention as defined in claim 1 wherein said air-fuel control comprises a fuel pressure regulator and a combustion blower, and wherein said pilot includes a first control coupling to said fuel pressure regulator and a second control coupling to said combustion blower.

5. A method for maintaining a Stirling engine working fluid at a substantially constant temperature comprising:

controlling the combustion energy output by controlling the air-fuel ratio supplied to the combustion system of the Stirling engine including controlling the air flow from a combustion compressor and controlling the pressure of fuel from a natural gas supply;

sensing the oxygen level of the combustion exhaust gases and generating a control input signal; and adjusting at least one of said input air flow and gas supply pressure in response to said control input signal.

6. The invention as defined in claim 5 wherein said adjusting step comprises adjusting the output of a fuel pressure regulator.

7. The invention as defined in claim 5 wherein said adjusting step comprises adjusting the speed of a combustion blower.

8. The invention as defined in claim 6 wherein said adjusting step comprises adjusting the speed of a combustion blower.

9. The invention as defined in claim 5 wherein said step of controlling the air-fuel ratio comprises sensing at least one operating condition of the engine and generating a signal level responsive to said at least one operating condition.

10. The invention as defined in claim 9 wherein said at least one condition is selected from the group consisting of working fluid temperature, fluid pressure, engine load, exhaust gas emissions and engine speed.

11. The invention as defined in claim 9 wherein said conditioned input signal is compared with said reference level signal.

12. A control system for a Stirling cycle engine supplied by a source of natural gas fuel, comprising:

microprocessor control means for generating control signals responsive to sensor inputs;

a first engine condition sensor for detecting heat exchange temperature and generating a first response signal;

a compressor electrically coupled for receiving a first control signal from said microprocessor control means in response to said first response signal and for discharging controlled amounts of air into the combustion chamber;

a second engine condition sensor for detecting constituent gas levels in the combustion chamber exhaust and generating a representative response signal; and a fuel regulator electrically coupled for receiving a second control signal from said microprocessor control means in response to said representative response signal and for adjusting fuel pressure from the source to the combustion chamber.

13. The invention as defined in claim 12 wherein said Stirling engine compressor outlet communicates with a fuel orifice in a combustion chamber venturi nozzle and further comprising:

the fuel regulator being coupled between the natural gas supply and the venturi orifice in the combustion chamber.

14. The invention as defined in claim 12 wherein said second engine condition sensor comprises a universal exhaust gas oxygen sensor.

15. The invention as defined in claim 12 wherein said second engine condition sensor comprises a lean exhaust gas oxygen sensor.

* * * * *